US011224101B2

(12) United States Patent
Lee et al.

(10) Patent No.: US 11,224,101 B2
(45) Date of Patent: Jan. 11, 2022

(54) COOKING APPARATUS AND METHOD FOR CONTROLLING THEREOF

(71) Applicant: Samsung Electronics Co., Ltd., Suwon-si (KR)

(72) Inventors: Kilyoung Lee, Suwon-si (KR); Jinseok Kwon, Suwon-si (KR); Jongho Park, Suwon-si (KR); Jinhee Cho, Suwon-si (KR); Kumchul Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 337 days.

(21) Appl. No.: 16/364,705

(22) Filed: Mar. 26, 2019

(65) Prior Publication Data

US 2020/0187309 A1 Jun. 11, 2020

(30) Foreign Application Priority Data

Dec. 5, 2018 (KR) ..... 10-2018-0155541

(51) Int. Cl.
*H05B 6/06* (2006.01)
*H05B 3/68* (2006.01)
*H05B 1/02* (2006.01)

(52) U.S. Cl.
CPC ..... *H05B 6/065* (2013.01); *H05B 1/0266* (2013.01); *H05B 3/68* (2013.01); *H05B 2213/07* (2013.01)

(58) Field of Classification Search
CPC ..... H05B 6/065; H05B 3/36; H05B 1/0266; H05B 2213/07
USPC ..... 219/620, 621, 622, 660, 662
See application file for complete search history.

(56) References Cited

U.S. PATENT DOCUMENTS 9,474,106 B2 10/2016 Park
9,618,210 B2 * 4/2017 Lee ..... H05B 6/1209
2006/0289489 A1 * 12/2006 Wang ..... H05B 6/065 219/622
2009/0139986 A1 * 6/2009 Lee ..... H05B 1/0266 219/622

(Continued)

FOREIGN PATENT DOCUMENTS

KR 10-0917902 B1 9/2009
KR 10-1321065 B1 10/2013

(Continued)

*Primary Examiner* — Thien S Tran
(74) *Attorney, Agent, or Firm* — Jefferson IP Law, LLP

(57) ABSTRACT

A cooking apparatus is provided. The cooking apparatus includes heating coils, an input apparatus receiving input of output levels for each of the heating coils, inverters providing driving power to each of the heating coils separately, and a processor controlling the inverters based on the inputted output levels. The processor is configured to predict the power consumption of each of the heating coils based on the inputted output levels, and based on the sum of the predicted power consumption being greater than a predetermined power value, determine a subject heating coil based on the predicted power consumption for each heating coil and history information on power adjustment of the heating coils, and control an inverter corresponding to the subject heating coil such that the subject heating coil operates at a smaller output level than a current output level.

20 Claims, 9 Drawing Sheets

(56) References Cited

U.S. PATENT DOCUMENTS

| | | | | |
|---|---|---|---|---|
| 2010/0282740 | A1* | 11/2010 | Artigas Maestre | H05B 6/065 219/662 |
| 2011/0192835 | A1* | 8/2011 | Lee | H05B 6/12 219/621 |
| 2012/0248098 | A1* | 10/2012 | Lee | H05B 6/1272 219/660 |
| 2013/0334213 | A1* | 12/2013 | Isoda | H05B 6/08 219/662 |
| 2014/0151365 | A1* | 6/2014 | Oh | H05B 6/065 219/620 |
| 2018/0168005 | A1* | 6/2018 | Yun | H05B 6/1272 |
| 2018/0242406 | A1* | 8/2018 | Yun | H05B 6/062 |
| 2018/0317284 | A1* | 11/2018 | Park | H05B 6/1236 |
| 2019/0029079 | A1* | 1/2019 | Calesella | H05B 6/065 |

FOREIGN PATENT DOCUMENTS

| | | | |
|---|---|---|---|
| KR | 10-2016-0018893 | A | 2/2016 |
| KR | 10-1621389 | B1 | 5/2016 |
| KR | 10-1657515 | B1 | 9/2016 |
| KR | 10-1733635 | B1 | 5/2017 |
| KR | 10-2017-0133980 | A | 12/2017 |
| KR | 10-2018-0025647 | A | 3/2018 |

* cited by examiner

FIG. 3

| CLASSIFICATION | POWER CONSUMPTION [W] | NUMBER OF TIMES OF ADJUSTMENT |
|---|---|---|
| 1 | 1800 | 0 |
| 2 | 1500 | 0 |
| 3 | 1200 | 0 |

FIG. 4

| CLASSIFICATION | POWER CONSUMPTION [W] | NUMBER OF TIMES OF ADJUSTMENT |
|---|---|---|
| 1 | 1800 | 1 |
| 2 | 1500 | 0 |
| 3 | 1200 | 0 |

FIG. 5

| CLASSIFICATION | POWER CONSUMPTION [W] | NUMBER OF TIMES OF ADJUSTMENT |
|---|---|---|
| 1 | 1500 | 1 |
| 2 | 1500 | 0 |
| 3 | 1200 | 0 |

FIG. 6

| CLASSIFICATION | POWER CONSUMPTION [W] | NUMBER OF TIMES OF ADJUSTMENT |
|---|---|---|
| 1 | 1500 | 1 |
| 2 | 1500 | 1 |
| 3 | 1200 | 0 |

FIG. 7

| CLASSIFICATION | POWER CONSUMPTION [W] |
|---|---|
| LEVEL 15 | 1800 |
| LEVEL 14 | 1500 |
| LEVEL 13 | 1300 |
| LEVEL 12 ~ LEVEL 1 | ⋮ |

FIG. 8

| CLASSIFICATION | 1 | 2 | 3 | SUM |
|---|---|---|---|---|
| LEVEL 15 | 1800 | 1200 | 1200 | 4200 |
| LEVEL 14 | 1500 | 1000 | 1000 | 3500 |
| LEVEL 13 | 1300 | 850 | 850 | 3000 |
| LEVEL 12 ~ LEVEL 1 | ⋮ | ⋮ | ⋮ | ⋮ |

COOKING APPARATUS AND METHOD FOR CONTROLLING THEREOF

CROSS-REFERENCE TO RELATED APPLICATION(S)

This application is based on and claims priority under 35 U.S.C. § 119(a) of a Korean patent application number 10-2018-0155541, filed on Dec. 5, 2018, in the Korean Intellectual Property Office, the disclosure of which is incorporated by reference herein in its entirety.

BACKGROUND

1. Field

The disclosure relates to a cooking apparatus and a controlling method thereof. More particularly, the disclosure relates to a cooking apparatus which divides power efficiently in an environment wherein power is limited and provides the power to a plurality of heating coils, and a controlling method thereof.

2. Description of Related Art

Cooking apparatuses are apparatuses that are used for cooking food, and types of cooking apparatuses can be divided into microwave ovens, hot wire apparatuses, induction heating apparatuses, and the like. Recently, cooking apparatuses adopting an induction heating method are widely used in place of gas apparatuses.

Meanwhile, a cooking apparatus adopting an induction heating method may be implemented in the form of having a plurality of burners, for satisfying a user's need to cook various kinds of food at once. However, there is a problem that a maximum output that can be implemented by power inputted to a cooking apparatus is limited, and thus cooking performance deteriorates when a plurality of burners are used at the same time, due to a limited output.

SUMMARY

The disclosure is aimed at providing a cooking apparatus which divides power to a plurality of heating coils efficiently in an environment wherein power is limited, and a controlling method thereof.

A cooking apparatus according to an embodiment of the disclosure may include a plurality of heating coils, an input apparatus receiving input of output levels for each of the plurality of heating coils, a plurality of inverters providing driving power to each of the plurality of heating coils separately, and a processor controlling the plurality of inverters based on the inputted output levels. The processor may predict the power consumption of each of the plurality of heating coils based on the inputted output levels, and if the sum of the predicted power consumption is greater than a predetermined power value, determine a subject heating coil based on the predicted power consumption for each heating coil and history information on power adjustment of the plurality of heating coils, and control an inverter corresponding to the subject heating coil such that the subject heating coil operates at a smaller output level than the current output level.

Meanwhile, a method for controlling a cooking apparatus including a plurality of heating coils according to an embodiment of the disclosure may include the steps of receiving input of output levels for each of the plurality of heating coils, predicting the power consumption of each of the plurality of heating coils based on the inputted output levels, and if the sum of the predicted power consumption is greater than a predetermined power value, determining a subject heating coil based on the predicted power consumption for each heating coil and history information on power adjustment of the plurality of heating coils, and controlling such that the subject heating coil operates at a smaller output level than the current output level.

BRIEF DESCRIPTION OF THE DRAWINGS

FIG. 3 is a diagram for illustrating a method of adjusting driving power provided to a plurality of heating coils;

FIG. 4 is a diagram for illustrating a method of adjusting driving power provided to a plurality of heating coils;

FIG. 5 is a diagram for illustrating a method of adjusting driving power provided to a plurality of heating coils;

FIG. 6 is a diagram for illustrating a method of adjusting driving power provided to a plurality of heating coils;

FIG. 7 is a diagram illustrating an example of power consumption information for each of a plurality of output levels;

FIG. 8 is a diagram illustrating an example of power consumption information for each of a plurality of output levels of each of a plurality of heating coils.

DETAILED DESCRIPTION

Figure 1:
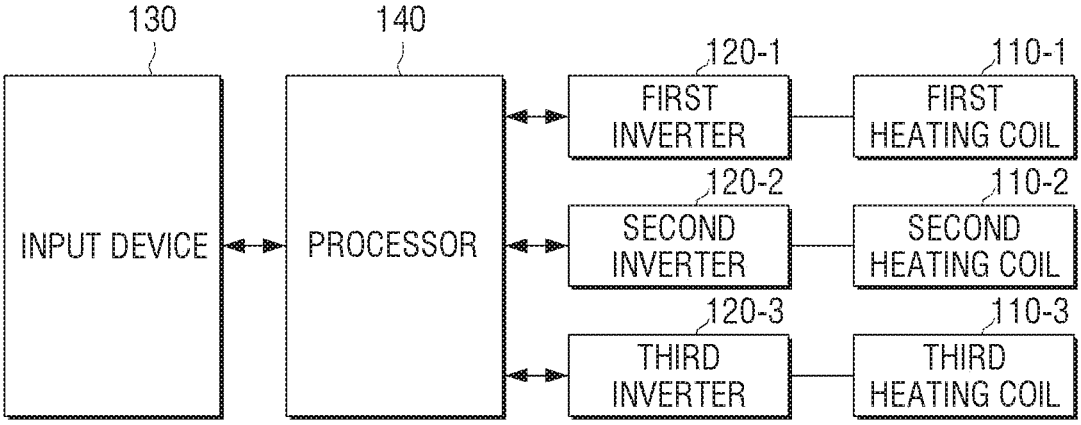
FIG. 1 is a block diagram for illustrating a schematic configuration of a cooking apparatus according to an embodiment of the disclosure.

Hereinafter, the terms used in this specification will be described briefly, and the disclosure will be described in detail.

As terms used in the embodiments of the disclosure, general terms that are currently used widely were selected as far as possible, in consideration of the functions described in the disclosure. However, the terms may vary depending on the intention of those skilled in the art who work in the pertinent field, previous court decisions or emergence of new technologies. Also, in particular cases, there may be terms that were designated by the applicant on his own, and in such cases, the meaning of the terms will be described in detail in the relevant descriptions in the disclosure. Thus, the terms used in the disclosure should be defined based on the meaning of the terms and the overall content of the disclosure, but not just based on the names of the terms.

Further, various modifications may be made to the embodiments of the disclosure, and there may be various types of embodiments. Accordingly, specific embodiments will be illustrated in drawings, and the embodiments will be described in detail in the detailed description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing embodiments, detailed explanation of related known technologies may unnecessarily confuse the gist of the disclosure, the detailed explanation will be omitted.

In addition, the expressions "first," "second" and the like used in the disclosure may be used to describe various elements, but the expressions are not intended to limit the elements. Such expressions are used only to distinguish one element from another element.

Also, singular expressions may be interpreted to include plural expressions, unless defined obviously differently in the context. In this specification, terms such as "include" and "consist of" should be construed as designating that there are such characteristics, numbers, steps, operations, elements, components or a combination thereof in the specification, but not as excluding in advance the existence or possibility of adding one or more of other characteristics, numbers, steps, operations, elements, components or a combination thereof.

In this specification, "a cooking apparatus" refers to an apparatus that heats, reheats or cools food by using a heat source such as gas, electricity and steam. As examples of such a cooking apparatus, there may be a gas range, a microwave oven, an oven, a toaster, a coffee machine, a grill or an induction heating cooking apparatus, and the like.

Hereinafter, the embodiments of the disclosure will be described in detail with reference to the accompanying drawings, such that those having ordinary skill in the art to which the disclosure belongs can easily carry out the disclosure. However, it should be noted that the disclosure may be implemented in various different forms, and is not limited to the embodiments described herein. Also, in the drawings, parts that are not related to explanation were omitted, for explaining the disclosure clearly.

Hereinafter, the disclosure will be described in more detail with reference to the accompanying drawings.

FIG. 1 is a block diagram for illustrating a schematic configuration of a cooking apparatus according to an embodiment of the disclosure.

Referring to FIG. 1, a cooking apparatus 100 consists of a plurality of heating coils 110-1, 110-2, 110-3, a plurality of inverters 120-1, 120-2, 120-3, an input device 130 and a processor 140.

The plurality of heating coils 110-1, 110-2, 110-3 perform heating operations based on the driving power provided. Such heating coils may be a heating element or an induction heating coil, and the like. For example, in case a heating coil is a heating element, it can generate heat by itself based on the driving power. Meanwhile, in case a heating coil is an induction heating coil, it can heat a cooking container on a burner by using an induction current.

Here, in the case of a cooking apparatus using an induction heating coil, if an alternating current is provided to the induction heating coil, a magnetic field passing through the inside of the induction heating coil is induced. In this case, the induced magnetic field passes through the bottom surface of the cooking container, and on the bottom surface, an eddy current which is a rotating current is generated, and by the eddy current generated, the bottom surface of the cooking container can be heated.

Also, the strength of the magnetic field generated at the induction heating coil may change according to the frequency of the alternating current provided to the induction heating coil. To be specific, as the frequency of the alternating current provided to the induction heating coil increases, the magnetic field may decrease, and as the frequency of the alternating current provided to the induction heating coil decreases, the magnetic field may increase.

Thus, by adjusting the driving frequency of the driving power provided to an induction heating coil, the strength of the magnetic field of the induction heating coil can be adjusted, and accordingly, the power consumption of the induction heating coil can be adjusted. Hereinafter, for the convenience of explanation, a case where the plurality of heating coils 110-1, 110-2, 110-3 are induction heating coils is assumed.

The plurality of inverters 120-1, 120-2, 120-3 provide driving power to each of the plurality of heating coils 110-1, 110-2, 110-3. To be specific, in order that driving power corresponding to the output level inputted from a user is provided to the heating coils, the plurality of inverters 120-1, 120-2, 120-3 may generate power inputted from the outside as driving power corresponding to the output level, and provide the generated driving power to each heating coil.

To be more specific, as the strength of the magnetic field that can be generated by heating coils changes according to the driving frequency of the driving power, as described above, the plurality of inverters 120-1, 120-2, 120-3 may provide driving power corresponding to the output level of the heating coils by adjusting the driving frequency.

Meanwhile, the input device 130 may receive input of a use instruction for the plurality of heating coils 110-1, 110-2, 110-3 from a user. Here, a use instruction is an instruction for performing an ON/OFF operation with respect to a heating coil to be controlled, or for receiving selection of an output level, and controlling such that the heating coil is heated to a corresponding degree of heating. For the output level, a value that directly corresponds to the level (e.g., 1 to 15) may be inputted, or a relative change value (e.g., +1/−1) may be inputted.

Also, the input device 130 may receive input of a value corresponding to a boost function of providing a maximum output. Then, the processor 140 may control a corresponding inverter such that a maximum output can be provided to the heating coil to which the boost function has been inputted. Here, a maximum output may be a value which is close to the maximum output that can be provided by the power inputted from the outside.

For example, in case the boost function has been inputted to the first heating coil 110-1, the processor 140 may control the first inverter 120-1 such that 3000 W which is close to the maximum output 3680 W that can be provided by the power inputted from the outside is provided to the first heating coil 110-1.

Meanwhile, the boost function may also be referred to as a turbo function and the like, and is not limited thereto.

The input device 130 as described above may be implemented as a plurality of physical buttons or switches, and the like. Alternatively, it may also be implemented as a touch screen that can simultaneously perform a display function of displaying an operating state, etc.

The processor 140 controls each element inside the cooking apparatus 100. To be specific, when the processor 140 receives input of a use instruction for each heating coil through the input device 130, it may control the plurality of inverters 120-1, 120-2, 120-3 such that a heating coil corresponding to the inputted use instruction operates.

To be specific, the processor 140 may control the plurality of inverters 120-1, 120-2, 120-3 such that driving power corresponding to use instructions for each of the plurality of heating coils 110-1, 110-2, 110-3 inputted from the input device 130 is provided to each of the plurality of heating coils 110-1, 110-2, 110-3.

To be more specific, the processor 140 may identify power consumption corresponding to the output levels for each of the plurality of heating coils 110-1, 110-2, 110-3 inputted from the input device 130 by using power consumption information for each output level, and control the plurality of inverters 120-1, 120-2, 120-3 to provide driving power corresponding to the identified power consumption to the plurality of heating coils 110-1, 110-2, 110-3.

For example, when a use instruction requesting an output of level 10 for the first heating coil 110-1 is inputted, the processor 140 may identify 1000 W which is the power consumption corresponding to the output of level 10 from the power consumption information for each output level, and control the first inverter 120-1 to provide driving power corresponding to 1000 W to the first heating coil 110-1.

Meanwhile, when a use instruction requesting an output of level 15 for the second heating coil 110-2 is inputted, the processor 140 may identify 1800 W which is the power consumption corresponding to the output of level 15 from the power consumption information for each output level, and control the second inverter 120-2 to provide driving power corresponding to 1800 W to the second heating coil 110-2.

In addition, when a use instruction requesting an output of level 5 for the third heating coil 110-3 is inputted, the processor 140 may identify 500 W which is the power consumption corresponding to the output of level 5 from the power consumption information for each output level, and control the third inverter 120-3 to provide driving power corresponding to 500 W to the third heating coil 110-3.

Further, in case output levels for two or more heating coils are inputted through the input device 130, the processor 140 may restrict the boost function of providing a maximum output, in order to prevent a case wherein driving power is concentrated on a specific heating coil, and thus the remaining heating coils cannot be provided with driving power corresponding to the inputted output levels.

For example, in case output levels for the first heating coil 110-1 and the second heating coil 110-2 are inputted, the processor 140 may restrict the boost function for the entire heating coils.

As another example, if an output level for the second heating coil 110-2 is inputted while the first heating coil 110-1 is operating in a boost function, the processor 140 may restrict the boost function of the first heating coil 110-1, and control the first heating coil 110-1 to operate in an output level of another stage.

Meanwhile, before controlling the plurality of inverters 120-1, 120-2, 120-3 for providing driving power to the plurality of heating coils 110-1, 110-2, 110-3, the processor 140 may identify whether the sum of the power consumption required for the plurality of heating coils 110-1, 110-2, 110-3 exceeds a predetermined power value.

To be specific, the processor 140 may predict power consumption of each of the plurality of heating coils 110-1, 110-2, 110-3 based on the output levels inputted for each of the plurality of heating coils 110-1, 110-2, 110-3, and identify whether the sum of the predicted power consumption exceeds a predetermined power value.

Here, a predetermined power value means maximum power that can be provided by using power inputted to the cooking apparatus 100 from the outside. For example, in case power inputted from the outside has a standard of 230V, 16 A, the predetermined power value may be 3680 W(230V×16 A×=3680 W). Meanwhile, a predetermined power value may be set as a value which is smaller than the maximum power that can be provided by using power inputted from the outside, and is not limited to the aforementioned example.

A case wherein the sum of the predicted power consumption for each of the plurality of heating coils 110-1, 110-2, 110-3 does not exceed a predetermined power value means that power required at the plurality of heating coils 110-1, 110-2, 110-3 can be provided by using power inputted from the outside. Accordingly, the processor 140 may control the plurality of inverters 120-1, 120-2, 120-3 such that driving power corresponding to the use instruction is provided to each of the plurality of heating coils 110-1, 110-2, 110-3.

In contrast, a case wherein the sum of the predicted power consumption for each of the plurality of heating coils 110-1, 110-2, 110-3 exceeds a predetermined power value means that sufficient power required at the plurality of heating coils 110-1, 110-2, 110-3 cannot be provided by using power inputted from the outside. Accordingly, the processor 140 may reduce the driving power provided such that the power consumption of the plurality of heating coils 110-1, 110-2, 110-3 is reduced.

For this, the processor 140 may determine a subject heating coil for which the driving power is to be reduced, among the plurality of heating coils 110-1, 110-2, 110-3. Then, the processor 140 may control an inverter corresponding to the subject heating coil, so that the driving power provided to the subject heating coil is reduced. The processor 140 may repeat the aforementioned operation until the sum of the predicted power consumption for each of the plurality of heating coils 110-1, 110-2, 110-3 does not exceed a predetermined power value.

Hereinafter, a specific operation of the processor 140 of determining a heating coil for which the driving power provided is to be adjusted among the plurality of heating coils 110-1, 110-2, 110-3 will be described.

First, the processor 140 may determine a subject heating coil for which the driving power provided is to be adjusted among the plurality of heating coils 110-1, 110-2, 110-3. To be specific, the processor 140 may determine a subject heating coil of which power consumption is to be reduced based on the power consumption of the plurality of heating coils 110-1, 110-2, 110-3 and the history information on power adjustment of the plurality of heating coils 110-1, 110-2, 110-3.

Here, the history information on power adjustment of the plurality of heating coils 110-1, 110-2, 110-3 means history information on the operation of adjusting the driving power provided to each of the plurality of heating coils 110-1, 110-2, 110-3. To be specific, the history information means history information that each of the plurality of heating coils 110-1, 110-2, 110-3 was determined as a subject heating coil, and the driving power provided to the coils was reduced. Also, the history information on power adjustment may include information on the number of times of an adjusting operation of the driving power performed on each of the plurality of heating coils 110-1, 110-2, 110-3.

For example, in case the first heating coil 110-1 was never determined as a subject heating coil, the number of times of adjusting power for the first heating coil 110-1 may be 0. In contrast, in case the first heating coil 110-1 was determined as a subject heating coil once, the number of times of adjusting power for the first heating coil 110-1 may be 1.

Meanwhile, the reason for considering the history information on power adjustment of the plurality of heating coils 110-1, 110-2, 110-3 is to prevent adjustment of driving power continuously provided to only a specific heating coil among the plurality of heating coils 110-1, 110-2, 110-3, and to make driving power adjusted evenly for the plurality of heating coils 110-1, 110-2, 110-3.

Further, the processor 140 may identify a heating coil having the biggest power consumption among the plurality of heating coils 110-1, 110-2, 110-3. Then, the processor 140 may identify whether the number of times of power adjustment of the heating coil having the biggest power consumption exceeds a predetermined number of times.

Here, the predetermined number of times is the number of times that is set to apply adjustment of driving power evenly to the plurality of heating coils 110-1, 110-2, 110-3, and it may be 0 or 1. Meanwhile, the predetermined number of times is not limited to the aforementioned example, and it may be set by a manufacturer or a user.

In case the number of times of power adjustment of the heating coil having the biggest power consumption does not exceed the predetermined number of times, the processor 140 may determine the heating coil having the biggest power consumption as the subject heating coil.

For example, in case a heating coil having the biggest power consumption among the plurality of heating coils 110-1, 110-2, 110-3 is the first heating coil 110-1, the number of times of power adjustment of the first heating coil 110-1 may be identified. Then, in case the number of times of power adjustment of the first heating coil 110-1 is 0 which does not exceed the predetermined number of times 0, the processor 140 may determine the first heating coil 110-1 as the subject heating coil.

In contrast, in case the number of times of power adjustment of the heating coil having the biggest power consumption exceeds a predetermined number of times, the processor 140 may determine a subject heating coil among the remaining heating coils excluding the heating coil having the biggest power consumption.

For example, in case a heating coil having the biggest power consumption among the plurality of heating coils 110-1, 110-2, 110-3 is the first heating coil 110-1, the processor 140 may identify the number of times of power adjustment of the first heating coil 110-1. Then, in case the number of times of power adjustment of the first heating coil 110-1 is 1 which exceeds the predetermined number of times 0, the processor 140 may determine a subject heating coil among the remaining heating coils excluding the first heating coil 110-1.

Meanwhile, detailed explanation for an operation of determining a subject heating coil among the plurality of heating coils 110-1, 110-2, 110-3 will be described below with reference to FIGS. 3 to 6.

Further, the processor 140 may control an inverter corresponding to the subject heating coil such that driving power provided to the subject heating coil is reduced. To be specific, the processor 140 may control an inverter corresponding to the subject heating coil such that the subject heating coil operates at a smaller output level than the current output level.

To be more specific, the processor 140 may control an inverter corresponding to the subject heating coil such that the subject heating coil has power consumption corresponding to a smaller output level than the current output level.

Meanwhile, a specific operation of controlling an inverter corresponding to the subject heating coil such that the driving power provided to the subject heating coil is reduced will be described below with reference to FIGS. 7 and 8.

Further, the processor 140 may store the number of times of power adjustment of the subject heating coil when the driving power provided to the subject heating coil is reduced. For example, in case the number of times of power adjustment of the first heating coil 110-1 was 0, but the driving power provided to the heating coil was reduced as the heating coil was determined as the subject heating coil, the processor 140 may update the number of times of power adjustment of the first heating coil 110-1 to 1.

As described above, the processor 140 may reduce the driving power provided to the plurality of heating coils 110-1, 110-2, 110-3 in the order of having bigger power consumption, and at the same time, make the driving power restricted evenly for the plurality of heating coils 110-1, 110-2, 110-3 in consideration of the number of times of power adjustment, and thereby prevent sudden change of the output of a specific heating coil.

Also, in case all of the respective numbers of times of power adjustment of each of the plurality of heating coils 110-1, 110-2, 110-3 exceed a predetermined number of times, the processor 140 may reset all of the respective numbers of times of power adjustment of each of the plurality of heating coils 110-1, 110-2, 110-3.

To be specific, the processor 140 may update the number of times of power adjustment of the subject heating coil as the driving power provided to the subject heating coil is reduced, and then identify whether all of the respective numbers of times of power adjustment of each of the plurality of heating coils 110-1, 110-2, 110-3 exceed a predetermined number of times, and reset the respective numbers of times of power adjustment of each of the plurality of heating coils 110-1, 110-2, 110-3.

For example, the processor 140 may update the number of times of power adjustment of the first heating coil 110-1 to 1 as the driving power provided to the first heating coil 110-1 which is the subject heating coil is reduced, and then identify whether all of the respective numbers of times of power adjustment of each of the plurality of heating coils 110-1, 110-2, 110-3 exceed 0 which is the predetermined number of times.

In case all of the respective numbers of times of power adjustment of each of the plurality of heating coils 110-1, 110-2, 110-3 exceed 0, the processor 140 may reset the respective numbers of times of power adjustment of each of the plurality of heating coils 110-1, 110-2, 110-3 and store the number of times as 0.

In contrast, in case the number of times of power adjustment of the second heating coil 110-2 or the third heating coil 110-3 among the plurality of heating coils 110-1, 110-2, 110-3 is 0, the processor 140 may not reset the respective numbers of times of power adjustment of each of the plurality of heating coils 110-1, 110-2, 110-3.

Here, the case wherein all of the respective numbers of times of power adjustment of each of the plurality of heating coils 110-1, 110-2, 110-3 exceed a predetermined number of times means that power provided to the plurality of heating coils 110-1, 110-2, 110-3 has been adjusted evenly.

Accordingly, in case sufficient power required still cannot be provided by the power inputted from the outside, and it is necessary to adjust the driving power for the plurality of heating coils 110-1, 110-2, 110-3 again, the processor 140 may reset the number of times of power adjustment such that power provided to the plurality of heating coils 110-1, 110-2, 110-3 is adjusted evenly, and perform adjustment of the driving power again.

Thus, by resetting the number of times of power adjustment of the plurality of heating coils 110-1, 110-2, 110-3, it is possible to perform adjustment of the driving power provided to the plurality of heating coils 110-1, 110-2, 110-3 again, in case sufficient power required still cannot be provided by the power inputted from the outside.

Meanwhile, in illustrating and describing FIG. 1, it was illustrated and described that there are three heating coils and three inverters, but in actual implementation, only two heating coils and two inverters may be included, or four or more heating coils and four or more inverters may be included.

Also, while it was described that the number of inverters and the number of heating coils are identical, actual implementation may be in the form of one inverter providing driving power to a plurality of heating coils.

In addition, while only simple elements constituting a cooking apparatus have been illustrated and described above, various elements may be additionally included in actual implementation. Hereinafter, description of such elements will be made with reference to FIG. 2.

Figure 2:
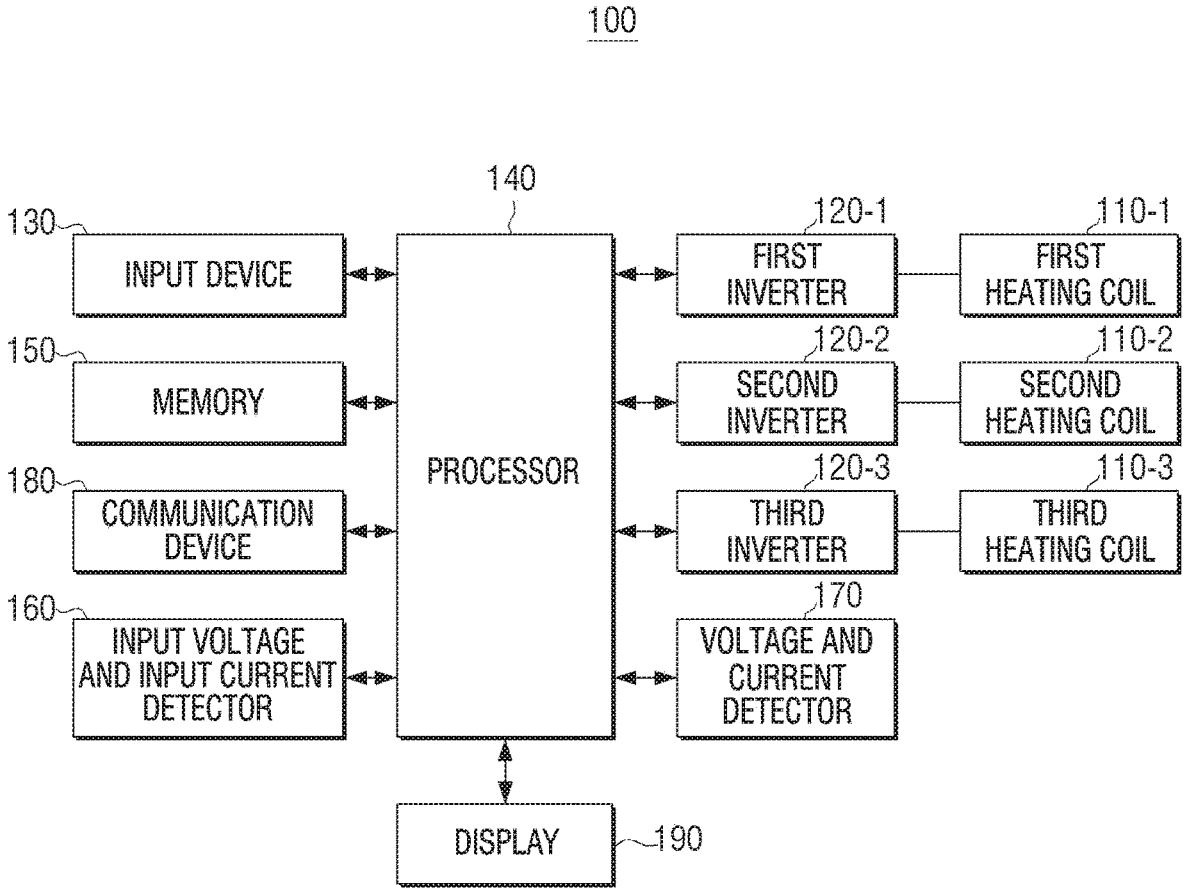
FIG. 2 is a block diagram for illustrating a detailed configuration of a cooking apparatus according to an embodiment of the disclosure.

FIG. 2 is a block diagram for illustrating a detailed configuration of a cooking apparatus according to an embodiment of the disclosure.

Referring to FIG. 2, a cooking apparatus 100 may consist of a plurality of heating coils 110-1, 110-2, 110-3, a plurality of inverters 120-1, 120-2, 120-3, an input device 130, a processor 140, a memory 150, an input voltage and input current detector 160, a voltage and current detector 170, a communication device 180 and a display 190.

As the plurality of heating coils 110-1, 110-2, 110-3, the plurality of inverters 120-1, 120-2, 120-3 and the input device 130 perform the same functions as in FIG. 1, overlapping descriptions will be omitted. Also, as the processor 140 was described with respect to FIG. 1, overlapping descriptions made in FIG. 1 will not be described, but only descriptions related to the elements added to FIG. 2 will be described below.

The memory 150 stores various types of data for the overall operations of the cooking apparatus 100 such as a program for processing or controlling the processor 140, and the like. To be specific, the memory 150 may store a plurality of application programs operated at the cooking apparatus 100, and data and instructions for operations of the cooking apparatus 100.

In addition, the memory 150 is accessed by the processor 140, and reading/recording/correction/deletion/update, etc. of data by the processor 140 may be performed. The memory 150 as described above may be implemented not only as a storage medium inside the cooking apparatus 100, but also as an external storage medium, a removable disk including USB memory, a web server through a network, and the like.

Further, the memory 150 may store power consumption information for each of a plurality of output levels. Also, the processor 140 may identify information on power consumption corresponding to the output levels of the plurality of heating coils 110-1, 110-2, 110-3 inputted through the input device 130, and control the plurality of inverters 120-1, 120-2, 120-3 such that the identified power consumption is provided to each of the plurality of heating coils 110-1, 110-2, 110-3.

In addition, the memory 150 may store information on the power consumption of each of the plurality of output levels that is different for each of the plurality of heating coils 110-1, 110-2, 110-3. To be specific, the memory 150 may store information wherein each of the plurality of heating coils 110-1, 110-2, 110-3 has a different output level, and further, each of the output levels has different power consumption.

Meanwhile, detailed description of the power consumption information for each of the plurality of output levels will be described below with reference to FIGS. 7 and 8.

Also, the memory 150 may store history information on power adjustment of the plurality of heating coils 110-1, 110-2, 110-3.

The input voltage and input current detector 160 is connected to the input power, and may detect the current or voltage of the input power provided to the plurality of inverters 120-1, 120-2, 120-3. Then, the input voltage and input current detector 160 may provide the result of detection to the processor 140.

The voltage and current detector 170 is connected to each of the plurality of heating coils 110-1, 110-2, 110-3, and may detect the voltage or current flowing in each of the plurality of heating coils 110-1, 110-2, 110-3, and provide information on the detected voltage or current to the processor 140.

For example, the voltage and current detector 170 may include a current transformer which is reduced proportionally to the size of the current provided to each of the plurality of heating coils 110-1, 110-2, 110-3, and an ampere meter which detects the size of the current which is reduced proportionally.

As another example, the voltage and current detector 170 may include shunt resistance connected to each of the plurality of heating coils 110-1, 110-2, 110-3, and a measurement device which measures voltage drop generated at the shunt resistance.

Meanwhile, the processor 140 may calculate the phase of the current flowing in each heating coil based on the detection results at the input voltage and input current detector 160 and the voltage and current detector 170. Then, the processor 140 may change the phase of the driving power provided to each heating coil based on the calculated phase information. Further, the processor 140 may change the power of the driving power provided to the heating coils through phase change of the driving power.

To be specific, in case the plurality of heating coils 110-1, 110-2, 110-3 are located adjacent to one another, and driving power having the same driving frequency is inputted, a magnetic flux line generated at a heating coil may exert influence in a heating region of another coil as a mutual induction voltage. Accordingly, in case driving power having the same driving frequency is inputted to the plurality of heating coils 110-1, 110-2, 110-3, the power of the driving power may change according to the phase of the driving power.

Thus, the processor 140 may change the phase of the driving power based on the detection results at the input voltage and input current detector 160 and the voltage and current detector 170, and thereby change the power of the driving power.

Meanwhile, the communication device 180 is connected to an external device (not shown), and may receive various types of data from the external device. To be specific, the communication device 180 may not only be in the form of being connected to an external device through a local area network (LAN) and an Internet network, but may also be in the form of being connected through a universal serial bus (USB) port or a wireless communication (e.g., WiFi 802.11a/b/g/n, NFC, Bluetooth) port. Here, an external device may be a PC, a laptop computer, a smartphone, a server, and the like.

The display 190 may display various types of information provided at the cooking apparatus 100. To be specific, the display 190 may display an operating state of the cooking apparatus 100, or display a user interface window for selecting the function and option selected by a user.

To be specific, the display 190 may display the output level inputted to each of the plurality of heating coils 110-1, 110-2, 110-3. For example, the display 190 may display that the output level inputted to the first heating coil 110-1 is level 15, the output level inputted to the second heating coil 110-2 is level 10, and the output level inputted to the third heating coil 110-3 is level 5.

Also, in case output levels for two or more heating coils are inputted and the boost function of providing a maximum output is restricted, the display 190 may display a guide message regarding restriction of the boost function.

Further, the display 190 may display a guide message regarding a heating coil which was determined as a subject heating coil, and was made to operate at a smaller output level than the previous output level. For example, in case the first heating coil 110-1 was determined as a subject heating coil, and its output level was lowered from the previous level 10 to level 9, the display 190 may display a guide message indicating that the output level of the first heating coil 110-1 was lowered from level 10 to level 9.

Meanwhile, in illustrating and describing FIG. 2, it was illustrated and described that the memory is a separate feature from the processor. However, actual implementation may be in the form wherein the memory is included in the processor as an element.

In the conventional technology, in case sufficient power required at a plurality of heating coils could not be provided by using the power inputted from the outside, power for some heating coils among the plurality of heating coils was blocked. Accordingly, there was a problem that a plurality of heating coils could not be used at the same time.

However, in the disclosure, driving power for heating coils is adjusted in the order of having bigger power consumption among a plurality of heating coils, and the driving power is adjusted in consideration of the number of times of power adjustment, as described above. Accordingly, driving power provided to a plurality of heating coils is adjusted evenly, and thus an effect that a plurality of heating coils can be used at the same time, and a user does not recognize sudden change of the output of heating coils can be exerted.

FIGS. 3 to 6 are diagrams for illustrating methods of determining a subject heating coil for which the driving power provided is to be adjusted, among a plurality of heating coils.

Referring to FIGS. 3 to 6, the power consumption and the number of times of power adjustment of each of the plurality of heating coils 110-1, 110-2, 110-3 in various cases can be identified. Hereinafter, the methods by which the processor 140 determines a subject heating coil will be described for each case. Meanwhile, for the convenience of explanation, it is assumed that the predetermined times is 0.

First, referring to FIG. 3, it can be identified that the first heating coil 110-1 has power consumption of 1800 W, the second heating coil 110-2 has power consumption of 1500 W, and the third heating coil 110-3 has power consumption of 1200 W, and the number of times of power adjustment of all of the plurality of heating coils 110-1, 110-2, 110-3 is 0.

The processor 140 may identify that the heating coil having the biggest power consumption is the first heating coil 110-1. Also, the number of times of power adjustment of the first heating coil 110-1 is 0, which does not exceed the predetermined number of times. Accordingly, the processor 140 may determine the first heating coil 110-1 as the subject heating coil.

Meanwhile, referring to FIG. 4, it can be identified that the first heating coil 110-1 has power consumption of 1800 W, the second heating coil 110-2 has power consumption of 1500 W, and the third heating coil 110-3 has power consumption of 1200 W, and the number of times of power adjustment of the first heating coil 110-1 is 1, and the number of times of power adjustment of the second heating coil 110-2 and the third heating coil 110-3 is 0.

The processor 140 may identify that the heating coil having the biggest power consumption is the first heating coil 110-1. Also, the number of times of power adjustment of the first heating coil 110-1 is 1, which exceeds the predetermined number of times. Accordingly, the processor 140 may determine a subject heating coil between the remaining heating coils 110-2, 110-3 excluding the first heating coil 110-1.

To be specific, the processor 140 may identify a heating coil having bigger power consumption between the remaining heating coils 110-2, 110-3, and identify again whether the number of times of power adjustment of the heating coil having bigger power consumption between the remaining heating coils 110-2, 110-3 exceeds the predetermined number of times, and determine the heating coil as the subject heating coil.

Thus, the processor 140 may identify the second heating coil 110-2 having bigger power consumption between the remaining heating coils 110-2, 110-3 excluding the first heating coil 110-1, and as the number of times of power adjustment of the second heating coil 110-2 is 0, which does not exceed the predetermined number of times 0, the processor 140 may determine the second heating coil 110-2 as the subject heating coil.

Meanwhile, in case the number of times of power adjustment of the second heating coil 110-2 is 1, as the number exceeds the predetermined number of times 0, the processor 140 may determine a subject heating coil between the remaining heating coils excluding the second heating coil 110-2. In this case, the processor 140 may determine the third heating coil 110-3 as the subject heating coil.

Referring to FIG. 5, it can be identified that the first heating coil 110-1 and the second heating coil 110-2 have power consumption of 1500 W, and the third heating coil 110-3 has power consumption of 1200 W, and the number of times of power adjustment of the first heating coil 110-1 is 1, and the number of times of power adjustment of the second heating coil 110-2 and the third heating coil 110-3 is 0.

As can be seen above, as a result of identifying a heating coil having the biggest power consumption among the plurality of heating coils 110-1, 110-2, 110-3, there may be a plurality of heating coils having the biggest power consumption.

In this case, the processor 140 may compare the number of times of power adjustment of the plurality of heating coils having the biggest power consumption, and identify a heating coil having a fewer number of times of power adjustment. Then, the processor 140 may determine the identified heating coil as the subject heating coil depending on whether the number of times of power adjustment of the identified heating coil exceeds the predetermined number of times.

In case the number of times of power adjustment of the identified heating coil does not exceed the predetermined number of times, the processor 140 may determine the identified heating coil as the subject heating coil. In contrast, in case the number of times of power adjustment of the identified heating coil exceeds the predetermined number of times, the processor 140 may determine the remaining heating coil excluding the plurality of heating coils having the biggest power consumption as the subject heating coil, among the plurality of heating coils 110-1, 110-2, 110-3.

Accordingly, the processor 140 may compare the number of times of power adjustment of the first heating coil 110-1 and the second heating coil 110-2 having the biggest power consumption, and identify the second heating coil 110-2 as the heating coil having a fewer number of times of power adjustment. Then, as the processor 140 can identify that the number of times of power adjustment of the second heating coil 110-2 is 0, which does not exceed the predetermined number of times, the processor 140 may determine the second heating coil 110-2 as the subject heating coil.

Referring to FIG. 6, it can be identified that the first heating coil 110-1 and the second heating coil 110-2 have power consumption of 1500 W, and the third heating coil 110-3 has power consumption of 1200 W, and the number of times of power adjustment of the first heating coil 110-1 and the second heating coil 110-2 is 1, and the number of times of power adjustment of the third heating coil 110-3 is 0.

As can be seen above, there may be a case wherein the number of times of power adjustment of a plurality of heating coils having the biggest power consumption is the same.

In this case, the processor 140 may identify a heating coil to which an output level was inputted later between the plurality of heating coils having the biggest power consumption, and determine the heating coil to which an output level was inputted later as the subject heating coil, depending on whether the number of times of power adjustment of the heating coil to which an output level was inputted later exceeds the predetermined number of times.

In case the number of times of power adjustment of the heating coil to which an output level was inputted later does not exceed the predetermined number of times, the processor 140 may determine the heating coil to which an output level was inputted later as the subject heating coil. In contrast, in case the number of times of power adjustment of the heating coil to which an output level was inputted later exceeds the predetermined number of times, the processor 140 may determine the remaining heating coil excluding the plurality of heating coils having the biggest power consumption as the subject heating coil, among the plurality of heating coils 110-1, 110-2, 110-3.

Accordingly, the processor 140 may identify the second heating coil 110-2 as the heating coil to which an output level was inputted later, between the first heating coil 110-1 and the second heating coil 110-2 having the biggest power consumption. Then, as the processor 140 can identify that the number of times of power adjustment of the second heating coil 110-2 is 1, which exceeds the predetermined number of times, the processor 140 may determine the third heating coil 110-3 excluding the first heating coil 110-1 and the second heating coil 110-2 having the biggest power consumption as the subject heating coil.

In case the number of times of power adjustment of the first heating coil 110-1 and the second heating coil 110-2 is 0, as the number of times of power adjustment of the second heating coil 110-2 to which an output level was inputted later does not exceed the predetermined number of times, the processor 140 may determine the second heating coil 110-2 as the subject heating coil.

As described above, the processor 140 may reduce the driving power provided to the plurality of heating coils 110-1, 110-2, 110-3 in the order of having bigger power consumption, and at the same time, make the driving power restricted evenly for the plurality of heating coils 110-1, 110-2, 110-3 in consideration of the number of times of power adjustment, and thereby prevent sudden change of the output of a specific heating coil.

Meanwhile, in illustrating and describing FIGS. 3 to 6, methods of determining a subject heating coil for three heating coils were illustrated and described, but in actual implementation, the same methods of determining a subject heating coil may be applied to two heating coils or four or more heating coils.

FIG. 7 is a diagram illustrating an example of power consumption information for each of a plurality of output levels.

The memory 150 may store power consumption information for each of a plurality of output levels. To be specific, the memory 150 may store information on power consumption required for performing operations corresponding to each of the plurality of output levels of the plurality of heating coils 110-1, 110-2, 110-3.

Meanwhile, the processor 140 may identify information on power consumption corresponding to the output levels of the plurality of heating coils 110-1, 110-2, 110-3 by using information on power consumption for each of the plurality of output levels, and control the plurality of inverters 120-1, 120-2, 120-3 such that the identified power consumption is provided to each of the plurality of heating coils 110-1, 110-2, 110-3.

Then, when the subject heating coil is determined, the processor 140 may control an inverter corresponding to the subject heating coil such that the subject heating coil operates at a smaller output level than the current output level.

To be specific, the processor 140 may control an inverter corresponding to the subject heating coil such that the subject heating coil has power consumption corresponding to a smaller output level than the current output level.

For example, referring to FIG. 7, in case the current output level of the subject heating coil is level 14, the processor 140 may control an inverter corresponding to the subject heating coil such that the subject heating coil operates at level 13 which is one level lower than level 14. That is, the processor 140 may control an inverter corresponding to the subject heating coil such that 1300 W corresponding to level 13 is provided to the subject heating coil.

FIG. 8 is a diagram illustrating an example of power consumption information for each of a plurality of output levels of each of a plurality of heating coils.

The memory 150 may store power consumption information for each of a plurality of output levels of each of the plurality of heating coils 110-1, 110-2, 110-3. To be specific, the memory 150 may store information on a plurality of output levels in different numbers for each of the plurality of heating coils 110-1, 110-2, 110-3, and power consumption required to perform operations corresponding to each of the plurality of output levels.

Meanwhile, the processor 140 may identify information on power consumption corresponding to the output levels of the plurality of heating coils 110-1, 110-2, 110-3 by using information on power consumption for each of the plurality of output levels of each of the plurality of heating coils 110-1, 110-2, 110-3, and control the plurality of inverters 120-1, 120-2, 120-3 such that the identified power consumption is provided to each of the plurality of heating coils 110-1, 110-2, 110-3.

For example, referring to FIG. 8, even when all of the plurality of heating coils 110-1, 110-2, 110-3 have output levels of level 15, the power consumption of the heating coils may be different, as 1800 W for the first heating coil 110-1, and 1200 W for the second heating coil 110-2 and the third heating coil 110-3.

Then, when the subject heating coil is determined, the processor 140 may control an inverter corresponding to the subject heating coil such that the subject heating coil operates at a smaller output level than the current output level.

To be specific, the processor 140 may control an inverter corresponding to the subject heating coil such that the subject heating coil has power consumption corresponding to a smaller output level than the current output level by using information on power consumption for each of the plurality of output levels corresponding to the subject heating coil.

For example, in case the first heating coil 110-1 is determined as the subject heating coil, and the current output level of the first heating coil 110-1 is 15, the processor 140 may control the first inverter 120-1 such that the first heating coil 110-1 has power consumption 1500 W corresponding to level 14 which is one level lower than the current output level 15, by using information on power consumption for each of the plurality of output levels corresponding to the first heating coil 110-1.

As another example, in case the second heating coil 110-2 is determined as the subject heating coil, and the current output level of the second heating coil 110-2 is 15, the processor 140 may control the second inverter 120-2 such that the second heating coil 110-2 has power consumption 1000 W corresponding to level 14 which is one level lower than the current output level 15, by using information on power consumption for each of the plurality of output levels corresponding to the second heating coil 110-2.

Hereinafter, a series of operations wherein the processor 140 predicts the power consumption of each of the plurality of heating coils 110-1, 110-2, 110-3 based on the output levels inputted to each of the plurality of heating coils 110-1, 110-2, 110-3, and repeats an operation of adjusting the driving power provided to the subject heating coil, and distributes the driving power to the plurality of heating coils 110-1, 110-2, 110-3 through power inputted from the outside will be described.

Meanwhile, for the convenience of explanation, it will be assumed that the output level inputted to the first heating coil 110-1 is level 14, the output level inputted to the second heating coil 110-2 is level 15, and the output level inputted to the third heating coil 110-3 is level 15, and the power inputted from the outside has a standard of 230V, 16 A, and the predetermined number of times is 0.

First, the processor 140 predicts power consumption corresponding to the output levels inputted to each of the plurality of heating coils 110-1, 110-2, 110-3 by using information on power consumption for each of the plurality of output levels.

Referring to FIG. 8, the processor 140 may identify that the power consumption for the first heating coil 110-1 is predicted as 1500 W, and the power consumption for the second heating coil 110-2 and the third heating coil 110-3 is predicted as 1200 W, and the sum of the power consumption for the plurality of heating coils 110-1, 110-2, 110-3 is 3900 W, which exceeds the power that can be provided by power inputted from the outside, 3680 W(230V×16 A×=3680 W).

Accordingly, the processor 140 may control the first inverter 120-1 such that 1300 W corresponding to level 13 which is one level lower is provided to the first heating coil 110-1 having the biggest power consumption. Meanwhile, the number of times of power adjustment of the first heating coil 110-1 may be updated as 1.

Then, the processor 140 may predict the power consumption for each of the plurality of heating coils 110-1, 110-2, 110-3 again. Here, the processor 140 may identify that the power consumption for the first heating coil 110-1 is predicted as 1300 W, and the power consumption for the second heating coil 110-2 and the third heating coil 110-3 is predicted as 1200 W, and the sum of the power consumption for the plurality of heating coils 110-1, 110-2, 110-3 is 3700 W, which still exceeds the power that can be provided by power inputted from the outside.

Thus, the processor 140 may identify the first heating coil 110-1 as the heating coil having the biggest power consumption. However, as the number of times of power adjustment of the first heating coil is 1, which exceeds the predetermined number of times, the processor 140 may determine a subject heating coil between the second heating coil 110-2 and the third heating coil 110-3.

In this case, as the power consumption predicted for the second heating coil 110-2 and the third heating coil 110-3 is identical, and the number of times of power adjustment is also identical as 0, the processor 140 may determine the third heating coil 110-3 to which an output level was inputted later as the subject heating coil.

Accordingly, the processor 140 may control the third inverter 120-3 such that 1000 W corresponding to level 14 which is one level lower is provided to the third heating coil 110-3. Also, the processor 140 may update the number of times of power adjustment of the third heating coil 110-3 as 3.

Then, the processor 140 may predict the power consumption for each of the plurality of heating coils 110-1, 110-2, 110-3 again. Here, the power consumption for the first heating coil 110-1 is predicted as 1300 W, the power consumption for the second heating coil 110-2 is predicted as 1200 W, and the power consumption for the third heating coil 110-3 is predicted as 1000 W, and the sum of the power consumption for the plurality of heating coils 110-1, 110-2, 110-3 is 3500 W, which satisfies the power that can be provided by power inputted from the outside. Thus, the processor 140 may stop an operation of adjusting the driving power provided to the plurality of heating coils 110-1, 110-2, 110-3.

Meanwhile, methods of adjusting driving power provided to a plurality of heating coils by using information on power consumption for each of a plurality of output levels of each of a plurality of heating coils are not limited to the aforementioned embodiments.

Further, the processor 140 may control the plurality of inverters 120-1, 120-2, 120-3 based on the output levels of the plurality of heating coils 110-1, 110-2, 110-3.

Meanwhile, information on power consumption for each of a plurality of output levels of each of a plurality of heating coils is not limited to the embodiment illustrated in FIG. 8.

Also, in illustrating FIG. 8, it was illustrated that all of the plurality of heating coils 110-1, 110-2, 110-3 have output levels of from level 1 to level 15. However, actual implementation may be in the form wherein heating coils have different numbers of output levels, such as only the first heating coil 110-1 having output levels of from level 1 to level 15, and the remaining heating coils 110-2, 110-3 having only output levels of from level 1 to level 12.

In addition, in illustrating FIGS. 7 and 8, it was illustrated and described that the memory 150 stores information on power consumption for each of a plurality of output levels, but the processor 140 may also store information on power consumption for each of a plurality of output levels.

Figure 9:
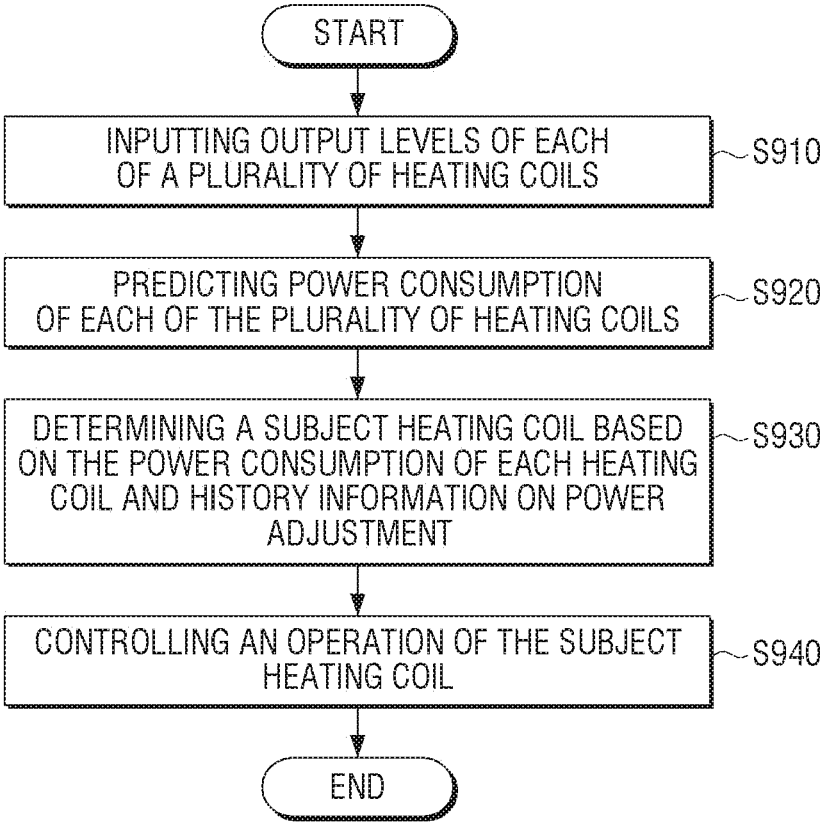
FIG. 9 is a flow chart for illustrating a method for controlling a cooking apparatus according to an embodiment of the disclosure.

FIG. 9 is a flow chart for illustrating a method for controlling a cooking apparatus according to an embodiment of the disclosure.

Referring to FIG. 9, first, output levels for each of a plurality of heating coils are inputted (S910). Then, power consumption of each of the plurality of heating coils is predicted based on the inputted output levels (S920). To be specific, power consumption of each of the plurality of heating coils corresponding to the inputted output levels may be predicted by using information on power consumption for each of the plurality of output levels.

Then, in case the sum of the predicted power consumption is greater than a predetermined power value, a subject heating coil is determined based on the predicted power consumption for each heating coil and history information on power adjustment of the plurality of heating coils (S930).

Here, a predetermined power value means a maximum power that can be provided by using power inputted to the cooking apparatus from the outside. Meanwhile, history information on power adjustment of the plurality of heating coils means history information on an operation of adjusting the driving power provided to each of the plurality of heating coils. Also, the history information on power adjustment may include information on the number of times of an adjusting operation of the driving power performed on each of the plurality of heating coils.

To be specific, a heating coil having the biggest power consumption among the plurality of heating coils may be identified. Then, the heating coil having the biggest power consumption may be determined as a subject heating coil depending on whether the number of times of power adjustment of the heating coil having the biggest power consumption exceeds a predetermined number of times.

Here, the predetermined number of times is the number of times that is set to restrict power consumption evenly for the plurality of heating coils, and it may be 0 or 1. Meanwhile, the predetermined number of times is not limited to the aforementioned example, and it may be set by a manufacturer or a user.

In case the number of times of power adjustment of the heating coil having the biggest power consumption does not exceed the predetermined number of times, the heating coil having the biggest power consumption may be determined as the subject heating coil.

In contrast, in case the number of times of power adjustment of the heating coil having the biggest power consumption exceeds the predetermined number of times, a subject heating coil may be determined among the remaining heating coils excluding the heating coil having the biggest power consumption.

To be specific, the heating coil having the biggest power consumption among the remaining heating coils may be identified, and it may be identified again whether the number of times of power adjustment of the heating coil having the biggest power consumption among the remaining heating coils exceeds the predetermined number of times, and the heating coil may be determined as the subject heating coil.

Meanwhile, as a result of identifying a heating coil having the biggest power consumption among the plurality of heating coils, there may be a plurality of heating coils having the biggest power consumption.

In this case, the number of times of power adjustment of the plurality of heating coils having the biggest power consumption may be compared, and a heating coil having a fewer number of times of power adjustment may be identified. Then, the identified heating coil may be determined as the subject heating coil depending on whether the number of times of power adjustment of the identified heating coil exceeds the predetermined number of times.

Also, there may be a case wherein the number of times of power adjustment of a plurality of heating coils having the biggest power consumption is the same.

In this case, a heating coil to which an output level was inputted later may be identified, and the heating coil to which an output level was inputted later may be determined as the subject heating coil, depending on whether the number of times of power adjustment of the heating coil to which an output level was inputted later exceeds the predetermined number of times.

In case the number of times of power adjustment of the heating coil to which an output level was inputted later does not exceed the predetermined number of times, the heating coil to which an output level was inputted later may be determined as the subject heating coil. In contrast, in case the number of times of power adjustment of the heating coil to which an output level was inputted later exceeds the predetermined number of times, a subject heating coil may be determined among the remaining heating coils excluding the plurality of heating coils having the biggest power consumption.

Then, control is performed such that the subject heating coil operates at a smaller output level than the current output level (S940). To be specific, control may be performed such that driving power corresponding to a smaller output level than the current output level is provided to the subject heating coil, by using information on power consumption for each of the plurality of output levels.

Alternatively, control may be performed such that driving power corresponding to a smaller output level than the current output level is provided to the subject heating coil, by using information on power consumption for each of the plurality of output levels corresponding to the subject heating coil.

Further, in case the subject heating coil operates at a smaller output level than the current output level, information on the number of times of power adjustment of the subject heating coil may be updated.

In addition, in case all of the respective numbers of times of power adjustment of each of the plurality of heating coils exceed the predetermined number of times, all of the respective numbers of times of power adjustment of each of the plurality of heating coils may be reset. To be specific, after the number of times of power adjustment of the subject heating coil is updated as the driving power provided to the subject heating coil is reduced, it may be identified whether all of the respective numbers of times of power adjustment of each of the plurality of heating coils exceed the predetermined number of times, and the respective numbers of times of power adjustment of each of the plurality of heating coils may be reset.

Thus, in a method for controlling a cooking apparatus according to the disclosure, driving power for heating coils is adjusted in the order of having bigger power consumption among a plurality of heating coils, and the driving power is adjusted in consideration of the number of times of power adjustment. Accordingly, driving power provided to a plurality of heating coils is adjusted evenly, and thus an effect that a plurality of heating coils can be used at the same time, and a user does not recognize sudden change of the output of heating coils can be exerted. Meanwhile, a controlling method as illustrated in FIG. 9 may be performed on a cooking apparatus having the configuration as illustrated in FIG. 1 or 2, and it may also be performed on cooking apparatuses having different configurations.

Also, a controlling method as described above may be implemented by at least one execution program for executing a controlling method as described above, and such an execution program may be stored in a non-transitory computer-readable medium.

A non-transitory computer-readable medium refers to a medium that stores data semi-permanently, and is readable by machines, but not a medium that stores data for a short moment such as a register, a cache, and memory. To be specific, the aforementioned various applications or programs may be provided while being stored in non-transitory computer-readable media such as a CD, a DVD, a hard disc, a blue-ray disc, a USB, a memory card, a ROM and the like.

While preferred embodiments of the disclosure have been shown and described, the disclosure is not limited to the aforementioned specific embodiments, and it is apparent that various modifications can be made by those having ordinary skill in the art to which the disclosure belongs, without departing from the gist of the disclosure as claimed by the appended claims, and such modifications are within the scope of the descriptions of the claims.

What is claimed is:

1. A cooking apparatus comprising:

a plurality of heating coils;

an input apparatus receiving input of an output level for each of the plurality of heating coils;

a plurality of inverters providing driving power to each of the plurality of heating coils; and a processor controlling the plurality of inverters based on the inputted output levels, wherein the processor is configured to:

predict a power consumption of each of the plurality of heating coils based on the inputted output level for each of the plurality of heating coils, based on a sum of the predicted power consumption being greater than a predetermined power value, determine a subject heating coil based on the predicted power consumption for each heating coil and history information on power adjustment of the plurality of heating coils, and control an inverter corresponding to the subject heating coil such that the subject heating coil operates at a smaller output level than a current output level.

2. The cooking apparatus of claim 1, wherein the processor is configured to:

identify a heating coil with a biggest power consumption among the plurality of heating coils, and depending on whether a number of times of power adjustment of the heating coil with the biggest power consumption exceeds a predetermined number of times, determine the heating coil with the biggest power consumption as the subject heating coil.

3. The cooking apparatus of claim 2, wherein the processor is configured to:

based on the number of times of power adjustment of the heating coil with the biggest power consumption not exceeding the predetermined number of times, determine the heating coil with the biggest power consumption as the subject heating coil.

4. The cooking apparatus of claim 2, wherein the processor is configured to:

based on the number of times of power adjustment of the heating coil with the biggest power consumption exceeding the predetermined number of times, determine the subject heating coil among remaining heating coils excluding the heating coil with the biggest power consumption.

5. The cooking apparatus of claim 4, wherein the processor is configured to:

identify a heating coil with the biggest power consumption among the remaining heating coils, and depending on whether a number of times of power adjustment of the heating coil with the biggest power consumption among the remaining heating coils exceeds the predetermined number of times, determine the heating coil with the biggest power consumption among the remaining heating coils as the subject heating coil.

6. The cooking apparatus of claim 2, wherein the processor is configured to:

based on the heating coils with the biggest power consumption being in multiple numbers, identify a heating coil with a fewer number of times of power adjustment among the heating coils with the biggest power consumption in multiple numbers, and depending on whether the number of times of power adjustment of the identified heating coil exceeds the predetermined number of times, determine the identified heating coil as the subject heating coil.

7. The cooking apparatus of claim 6, wherein the processor is configured to:

based on the heating coils with the biggest power consumption being in multiple numbers, and the number of times of power adjustment of each of the heating coils with the biggest power consumption in multiple numbers being identical, identify a heating coil to which the output level was inputted later among the heating coils with the biggest power consumption in multiple numbers, and depending on whether the number of times of power adjustment of the heating coil to which the output level was inputted later exceeds the predetermined number of times, determine the heating coil as the subject heating coil.

8. The cooking apparatus of claim 1, further comprising:

a memory storing the history information on power adjustment of the plurality of heating coils, wherein the processor is configured to:

based on the subject heating coil operating at a smaller output level than the current output level, update information on a number of times of power adjustment of the subject heating coil in the history information on power adjustment of the plurality of heating coils.

9. The cooking apparatus of claim 1, wherein the processor is configured to:

based on all of respective numbers of times of power adjustment of each of the plurality of heating coils exceeding a predetermined number of times, reset all of the respective numbers of times of power adjustment of each of the plurality of heating coils.

10. The cooking apparatus of claim 1, further comprising:

a memory storing power consumption information for each of a plurality of output levels, wherein the processor is configured to:

control an inverter corresponding to the subject heating coil to provide the subject heating coil with driving power corresponding to an output level that is one level lower than the current output level based on the power consumption information for each of the plurality of output levels.

11. A method for controlling a cooking apparatus including a plurality of heating coils and a plurality of inverters providing driving power to each of the plurality of heating coils comprising:

receiving by an input apparatus, input of an output level for each of the plurality of heating coils; and controlling, by a processor, the plurality of inverters based on the inputted output level for each of the plurality of heating coils;

wherein the controlling the plurality of inverters comprises:

predicting a power consumption of each of the plurality of heating coils based on the inputted output level for each of the plurality of heating coils;

based on a sum of the predicted power consumption being greater than a predetermined power value, determining a subject heating coil based on the predicted power consumption for each heating coil and history information on power adjustment of the plurality of heating coils; and controlling an inverter corresponding to the subject heating coil such that the subject heating coil operates at a smaller output level than a current output level.

12. The method for controlling a cooking apparatus including a plurality of heating coils of claim 11, wherein determining a subject heating coil comprises:

identifying a heating coil with a biggest power consumption among the plurality of heating coils, and depending on whether a number of times of power adjustment of the heating coil with the biggest power consumption exceeds a predetermined number of times, determining the heating coil with the biggest power consumption as the subject heating coil.

13. The method for controlling a cooking apparatus including a plurality of heating coils of claim 12, wherein determining a subject heating coil comprises:

based on the number of times of power adjustment of the heating coil with the biggest power consumption not exceeding the predetermined number of times, determining the heating coil with the biggest power consumption as the subject heating coil.

14. The method for controlling a cooking apparatus including a plurality of heating coils of claim 12, wherein determining a subject heating coil comprises:

based on the number of times of power adjustment of the heating coil with the biggest power consumption exceeding the predetermined number of times, determining the subject heating coil among remaining heating coils excluding the heating coil with the biggest power consumption.

15. The method for controlling a cooking apparatus including a plurality of heating coils of claim 14, wherein determining a subject heating coil comprises:

identifying a heating coil with the biggest power consumption among the remaining heating coils, and depending on whether a number of times of power adjustment of the heating coil with the biggest power consumption among the remaining heating coils exceeds the predetermined number of times, determining the heating coil with the biggest power consumption among the remaining heating coils as the subject heating coil.

16. The method for controlling a cooking apparatus including a plurality of heating coils of claim 12, wherein determining a subject heating coil comprises:

based on the heating coils with the biggest power consumption being in multiple numbers, identifying a heating coil with a fewer number of times of power adjustment among the heating coils with the biggest power consumption in multiple numbers, and depending on whether the number of times of power adjustment of the identified heating coil exceeds the predetermined number of times, determining the identified heating coil as the subject heating coil.

17. The method for controlling a cooking apparatus including a plurality of heating coils of claim 16, wherein determining a subject heating coil comprises:

based on the heating coils with the biggest power consumption being in multiple numbers, and the number of times of power adjustment of each of the heating coils with the biggest power consumption in multiple numbers being identical, identifying a heating coil to which the output level was inputted later among the heating coils with the biggest power consumption in multiple numbers, and depending on whether the number of times of power adjustment of the heating coil to which the output level was inputted later exceeds the predetermined number of times, determining the heating coil as the subject heating coil.

18. The method for controlling a cooking apparatus including a plurality of heating coils of claim 11, further comprising:

based on the subject heating coil operating at a smaller output level than the current output level, updating information on a number of times of power adjustment of the subject heating coil in the history information on power adjustment of the plurality of heating coils.

19. The method for controlling a cooking apparatus including a plurality of heating coils of claim 11, further comprising:

based on all of respective numbers of times of power adjustment of each of the plurality of heating coils exceeding a predetermined number of times, resetting all of the respective numbers of times of power adjustment of each of the plurality of heating coils.

20. The method for controlling a cooking apparatus including a plurality of heating coils of claim 11, wherein controlling comprises:

controlling such that the subject heating coil is provided with driving power corresponding to an output level that is one level lower than the current output level based on a pre-stored power consumption information for each of a plurality of output levels.

* * * * *